United States Patent [19]

Washizuka et al.

[11] 4,408,096

[45] Oct. 4, 1983

[54] SOUND OR VOICE RESPONSIVE TIMEPIECE

[75] Inventors: Isamu Washizuka; Mitsuhiro Saiji, both of Kyoto, Japan

[73] Assignee: Sharp Kabushiki Kaisha, Osaka, Japan

[21] Appl. No.: 247,054

[22] Filed: Mar. 24, 1981

[30] Foreign Application Priority Data

Mar. 25, 1980 [JP] Japan ..... 55-38753

[51] Int. Cl.[3] ..... G10L 1/00

[52] U.S. Cl. ..... 381/107; 381/110; 368/63; 364/513.5

[58] Field of Search ..... 179/1 SM, 1 SD, 1 SB, 179/1 VC, 1 VL; 364/705, 706, 709, 710, 200 MS File, 900 MS File

[56] References Cited

U.S. PATENT DOCUMENTS 3,998,045 12/1976 Lester ..... 179/1 SM

FOREIGN PATENT DOCUMENTS 53-38627 3/1978 Japan .

OTHER PUBLICATIONS

J. Flanagan, "Computers that Talk and Listen . . . ", Proc. IEEE, Apr. 1976, pp. 405–415.

*Primary Examiner*—Emanuel S. Kemeny

*Attorney, Agent, or Firm*—Birch, Stewart, Kolasch & Birch

[57] ABSTRACT

A timepiece having a speech synthesizer output device is disclosed herein. The speech synthesizer is responsive to sound input such as human voices (e.g., what time is it?) or the sound of clapping of hands to provide an audible indication of time information. The intensity of the audible indication is varied with the intensity of the sound input.

1 Claim, 1 Drawing Figure

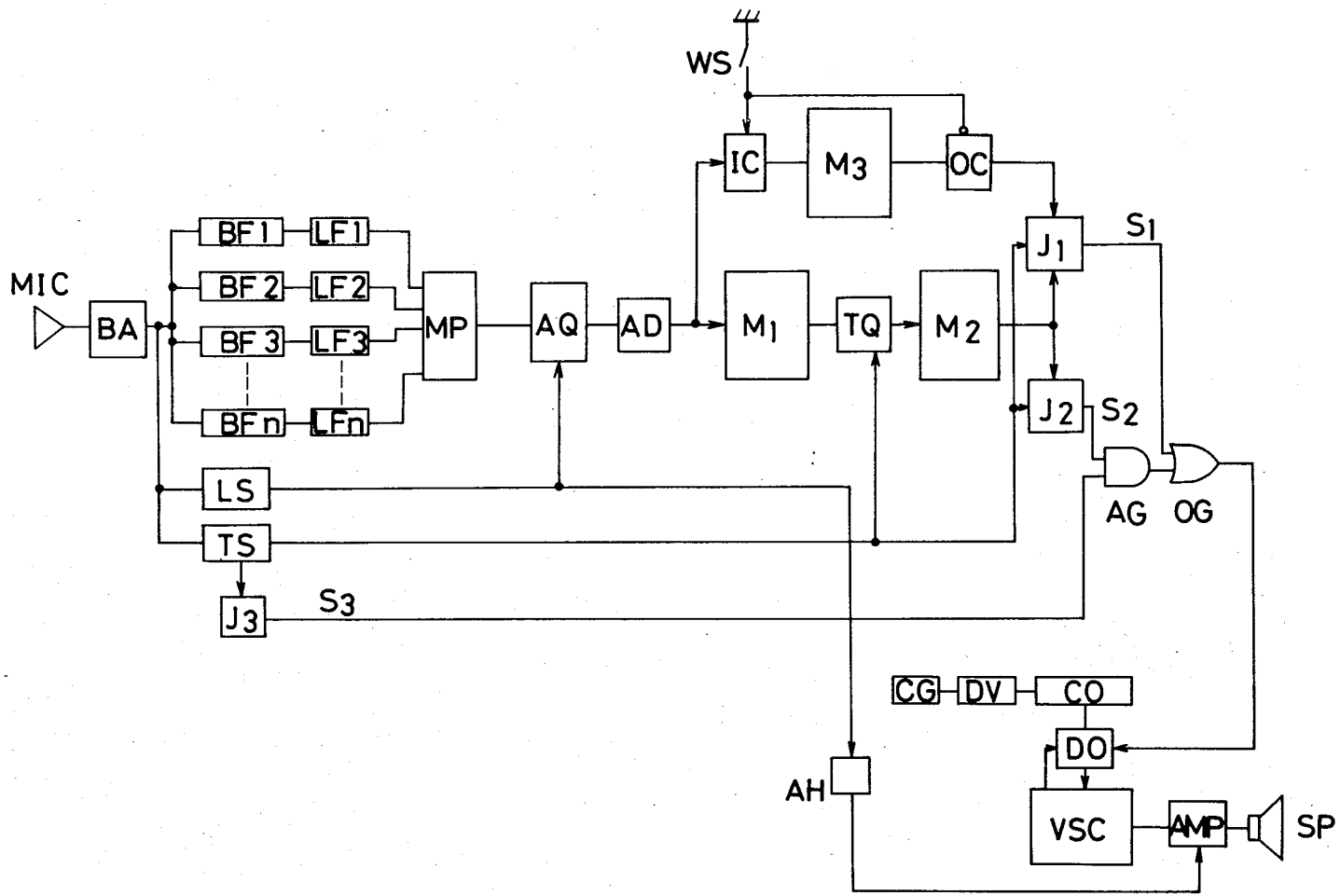
MIC
BA
BF1
BF2
BF3
BFn
LF1
LF2
LF3
LFn
MP
AQ
AD
M1
TQ
M2
J1
J2
S1
S2
S3
OG
AG
LS
TS
J3
WS
IC
M3
OC
CG
DV
CO
DO
VSC
AMP
SP
AH

SOUND OR VOICE RESPONSIVE TIMEPIECE

BACKGROUND OF THE INVENTION

This invention relates to a timepiece capable of providing an audible indication of time information in the form of synthesized human voices in response to a sound or voice.

Timepieces are known which provide, for example, by means of a liquid crystal display a visual display of time information in response to an incoming sound (as disclosed in Japanese Patent Publication No. 52/45507). Also known is a timepiece adapted to display time in response to sound or a clapping of hands (as disclosed in Japanese Patent Publication No. 53/38627). It may not be convenient to look at such a timepiece when the user is visually impaired or does not wish to divert his or her attention away from something for any reason.

With timepieces operable in response to actuation of an input means such as a key switch, a touch switch or a wireless remote control, a user may well operate such an input means in the vicinity of the timepieces so that a visual display of time, rather than an audible display, is adequate.

OBJECTS AND SUMMARY OF THE INVENTION

Accordingly, it is an object of the present invention to provide a timepiece capable of providing an audible indication of time information in response to sound or voice which avoids the above discussed problems with known devices.

It is another object of the present invention to provide a timepiece capable of providing an audible indication of time information in response to the sound of clapping of hands or words such as capable of "what time is it?" as well as controlling the intensity or volume of the audible display according to the intensity of the sound of clapping of hands or human voices.

BRIEF DESCRIPTION OF THE DRAWINGS

For a more complete understanding of the present invention and for further objects and advantages thereof, reference is now made to the following description taken in conjunction with the accompanying drawings, in which:

The single FIGURE of the drawings is a block diagram of a timepiece constructed in accordance with the present invention.

DETAILED DESCRIPTION OF THE INVENTION

Referring to the drawings, there is illustrated a timepiece according to an embodiment of the present invention, which includes a microphone MIC for receiving a sound or human voice, a buffer amplifier BA for amplification of the output of the microphone, a predetermined number of band pass filters $BF_1$–$BF_n$ for dividing the human voice input into several components of different frequency bands, an equal number of low pass filters $LF_1$–$LF_n$ one for each of the band pass filters, a multiplexer MP, a level detector LS for detecting the level of the sound or human voice from the buffer amplifier, a time axis detector TS, an amplifier normalizer AQ for normalizing the amplitude of each envelop output derived from the respective filters for each frequency band, an analog-to-digital converter AD for conversion of an analog signal to a digital signal. There is further provided a first sound information memory $M_1$, typically a RAM, for storing digital codes indicative of the normalized envelop outputs of the respective frequency bands, a second sound information memory $M_2$, typically a RAM, to which the contents of the first memory $M_1$ are loaded via time axis modifier TQ, and a third sound information memory $M_3$, typically a RAM, for storing the digital coded output of the analog-to-digital converter which converts the envelop output normalized according to the amplitude of the output signal of the level detector LS. The last memory $M_3$ has an input control IC and an output control OC. A time axis modifier TQ executes time axis modification on the contents of the memory $M_1$ in response to the output signal of the time axis detector TS and shifts the so modified contents of the first memory $M_1$ to the second memory $M_2$ upon completion of introduction of the sound input. A sound information comparator $J_1$ is operatively connected between the memories $M_2$ and $M_3$, while a comparator $J_2$ is connected between the memory $M_2$ and the time axis detector TS. The illustrated timepiece further includes an AND gate AG, an OR gate OG, a sound generation time detector $J_3$, a clock generator CG, a divider DV, a timekeeping counter CO, a data transmission control DO, a voice synthesizer control VSC, a loud speaker SP, a register switch WS for registering a specific instruction word of use for delivery of an audible indication of time information, an amplifier AMP and a hold circuit AH for holding the output of the level detector LS.

The above timepiece operates in the following manner.

(Register Mode)

This is a mode by which a word is registered for enabling the user to instruct the timepiece to deliver an audible indication of time information such as updated time of the day, alarm time settings and elapsed time, etc. For example, when a user wants to use the words "what time is it?" to learn the current time, the register switch WS is first switched ON and then the user says "what time is it?" into microphone MIC. The envelop outputs of the respective frequency bands are derived through the band pass filters $BF_1$–$BF_n$ and the low pass filters $LF_1$–$LF_n$ and normalized through the amplitude normalizer AQ. That is, the circuit AQ normalizes the respective envelop amplitudes based upon the amplitude of the output signal of the level detector LS. By the analog-to-digital converter AD the output signal of the AQ circuit is converted into digital codes and stored into the sound information memory $M_3$ via the input control IC. It is noted that under this circumstance the comparator $J_1$ is inhibited from reading the contents of the memory $M_3$ under control of the output control OC.

(Normal Mode)

By switching OFF the register switch WS, the timepiece is brought into normal mode wherein time will be audibly indicated when the user says the same words as previously registered in the timepiece. Firstly, the digital codes indicative of the normalized envelop outputs of the different frequency bands are loaded into the sound information memory $M_1$. Upon completion of introduction of the sound input, the time axis modifier TQ executes time axis modification on the contents of the memory $M_1$ based upon the output signal of the time axis detector TS and loads the resultant contents into the memory $M_2$. The purpose of the time axis modification is to compress or expand the digital signals to be equal in length to the length of time for audible indication regardless of whether it was said slowly or quickly. Thereafter, the comparator $J_1$ compares information in the memory $M_3$ and that in the memory $M_2$ and, if a degree of correlation of more than a given value is found, provides an agreement signal $S_1$. The data transfer control DO permits the count of the timekeeping counter to be serially shifted to the voice synthesizer control VSC. The amplifier AMP varies its amplification factor as a function of the amplitude of the output signal from the hold circuit AH and then drives the loud speaker SP. The hold circuit AH allows an audible indication of "it's now—" to be delivered with an enhanced intensity when the viewer says loudly "what time is it?." The comparator $J_2$ decides whether the contents of the memory $M_2$ contains a typical frequency band component characteristic of sound of clapping of hands and, when regarded as the hand clapping sound, provides a signal $S_2$. On the other hand, the circuit $J_3$ detects the length of time of the sound input and when it is less than a given length, provides a signal $S_3$. When the signals $S_2$ and $S_3$ have been developed the data transfer control DO becomes operable.

As stated previously, the present invention provides an audible indication of time in response to mere generation of a simple sound without special or difficult manipulation. Even children or feeble or handicapped persons can easily render the timepiece operable to audibly indicate time and whenever necessary.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A timepiece comprising:

means for receiving sound;

means for setting said timepiece in a first or second mode of operation;

means for storing at least one first sound received by said sound receiving means when said timepiece is in said first mode of operation;

means for comparing second sounds received by said sound receiving means when said timepiece is in said second mode of operation with said at least one first sound;

means for providing a signal when said second sounds are the same as said at least one first sound;

means for providing an audible indication of time information in response to said signal; and means for varying the amplitude of said audible indication of time information in response to the amplitude of said second sounds.

* * * * *